US007494512B2

(12) United States Patent
Brown et al.

(10) Patent No.: US 7,494,512 B2
(45) Date of Patent: Feb. 24, 2009

(54) COMPOSITIONS AND METHODS FOR CLEANING TEXTILE SUBSTRATES

(76) Inventors: Steven E. Brown, 520 Cambridge Dr., Spartanburg, SC (US) 29301; Marie S. Chan, 1188 Tanners Grove Rd., Forest City, NC (US) 28043; Michael A. Valenti, 109 Hickory Hill La., Greenville, SC (US) 29609; Michael J. McDonald, 35 Lake Forest Dr., Newman, GA (US) 30265; Shannon B. Stancil, 230 Douglas St., Glendale, SC (US) 29346; J. Michael Metcalf, 404 Carrington Dr., Boiling Springs, SC (US) 29316; Patrick D. Moore, 1169 Ashbury Rd., Pacolet, SC (US) 29372

( * ) Notice: Subject to any disclaimer, the term of this patent is extended or adjusted under 35 U.S.C. 154(b) by 201 days.

(21) Appl. No.: 10/783,064

(22) Filed: Feb. 20, 2004

(65) Prior Publication Data

US 2005/0183206 A1 Aug. 25, 2005

(51) Int. Cl.
*B08B 3/00* (2006.01)
*B08B 1/00* (2006.01)
*B08B 13/00* (2006.01)

(52) U.S. Cl. ..... 8/137; 510/278; 15/1; 15/22.1; 15/38; 15/40; 15/41.1; 15/42; 15/48; 15/50.1; 15/50.2; 134/34; 68/38; 68/63; 68/200; 68/220

(58) Field of Classification Search ..... 8/137; 510/278; 15/1, 22.1, 38, 40, 41.1, 42, 48, 15/50.1, 50.2; 134/34; 68/38, 63, 200, 220
See application file for complete search history.

(56) References Cited

U.S. PATENT DOCUMENTS

| | | | | | |
|---|---|---|---|---|---|
| 2,165,586 | A | | 7/1939 | Studer et al. | 87/5 |
| 3,184,781 | A | * | 5/1965 | Hoxie | 401/22 |
| 3,418,243 | A | | 12/1968 | Hoxie | 252/154 |
| 3,910,848 | A | * | 10/1975 | Froehlich et al. | 510/329 |
| 3,956,162 | A | | 5/1976 | Lautenberger | 252/162 |
| 4,013,594 | A | * | 3/1977 | Froehlich et al. | 510/278 |
| 4,108,800 | A | | 8/1978 | Froehlich | 252/541 |
| 4,194,993 | A | | 3/1980 | Deal, III | 252/541 |
| 4,434,067 | A | | 2/1984 | Malone et al. | 252/88 |
| 4,493,781 | A | * | 1/1985 | Chapman et al. | 510/278 |
| 4,594,362 | A | | 6/1986 | Smith et al. | 521/52 |
| 4,659,494 | A | | 4/1987 | Soldanski et al. | 252/88 |
| 4,685,930 | A | * | 8/1987 | Kasprzak | 8/139.1 |
| 4,802,997 | A | | 2/1989 | Fox et al. | 252/8.6 |
| 4,834,900 | A | | 5/1989 | Soldanski et al. | 252/88 |
| 4,873,000 | A | | 10/1989 | Weller | 252/8.6 |
| 4,908,149 | A | * | 3/1990 | Moore et al. | 510/278 |
| 5,037,485 | A | | 8/1991 | Chromecek et al. | 137/7 |
| 5,259,984 | A | | 11/1993 | Hull | 252/174.17 |
| 5,683,976 | A | | 11/1997 | Colurciello, Jr. et al. | 510/278 |
| 5,714,449 | A | | 2/1998 | Donker et al. | 510/304 |
| 5,783,543 | A | | 7/1998 | Fleckenstein et al. | 510/280 |
| 5,786,317 | A | | 7/1998 | Towsend | 510/278 |
| 5,928,384 | A | * | 7/1999 | Scialla et al. | 510/278 |
| 6,010,539 | A | | 1/2000 | Del Pesco | 8/137 |
| 6,068,665 | A | | 5/2000 | Calton et al. | 8/137 |
| 6,125,498 | A | * | 10/2000 | Roberts et al. | 15/320 |
| 6,569,210 | B1 | | 5/2003 | Chao et al. | 8/137 |
| 6,953,299 | B2 | * | 10/2005 | Wang et al. | 401/279 |
| 2003/0092589 | A1 | | 5/2003 | Todini et al. | 510/278 |
| 2003/0109399 | A1 | | 6/2003 | Todini et al. | 510/278 |

FOREIGN PATENT DOCUMENTS

| | | |
|---|---|---|
| CA | 0985113 | 3/1976 |
| EP | 1063282 | 5/2000 |
| EP | 1184449 | 9/2000 |
| FR | 2015972 | 4/1970 |

OTHER PUBLICATIONS shoplet.com (http://www.biochem.ucl.ac.uk/bsm/enzymes/ec3/ec01/ec01/ec0074/index.html) copyright 1994-2003.*

* cited by examiner

*Primary Examiner*—Lorna M Douyon
*Assistant Examiner*—Amina Khan
(74) *Attorney, Agent, or Firm*—Brenda D. Wentz

(57) ABSTRACT

This invention relates to new compositions and methods for cleaning textile substrates, especially carpet and upholstery fabrics. More particularly, this invention relates to liquid compositions that contain absorbent particles in a flowable fluid dispersion, which dries to a soil ladened powder, that can be removed by vacuuming, brushing, and/or laundering methods. The composition includes dispersion stabilizing additives such that the composition is presented as a stable dispersion or as a composition that may be easily redispersed prior to application.

16 Claims, No Drawings

COMPOSITIONS AND METHODS FOR CLEANING TEXTILE SUBSTRATES

BACKGROUND OF THE INVENTION

This invention relates to new compositions and methods for cleaning textile substrates, especially carpet and upholstery fabrics. More particularly, this invention relates to liquid compositions that contain absorbent particles in a flowable fluid dispersion, which dries to a soil ladened powder, that can be removed by vacuum, brushing, and/or laundering methods. Previous efforts in this area show a continuing need to improve four important features of the textile substrate, especially of the carpet or upholstery cleaning process. These features include: (a) the convenience of applying a cleaning composition, (b) the cleaning efficiency of the cleaning composition, (c) the length of time a cleaned textile is wet, and (d) the reduction of the resoil rate caused by residual surfactant.

The methods of cleaning of textile substrates may be generally placed into three categories. The first category involves the immersion of the textile into a cleaning solvent followed by agitation and removal of soiled solvent. In this case, water is the preferred solvent, provided that the fiber and/or textile substrate is stable to it. Typically, the additives used to facilitate soil removal by the solvent are surfactants, ionic chelators, and pH adjusters. Other minor ingredients are generally included to enhance the cleaning process. These include fragrances, bleaches, optical brighteners, and anti-resoil ingredients. For example, U.S. Pat. Nos. 5,786,317; 6,010,539; and 5,714,449 to Donker, et al., describe a non-aqueous liquid cleaning composition containing solid particles suspended by the use of hydrophobically modified silica particles. This composition is designed for liquid detergent concentrates for washing machine applications and the particles are active bleaching agents. If the textile is small, this process generally uses standard washing machines or dry cleaning machines to clean the textile. If the textile is large or physically affixed to an object, this process uses portable liquid applicators and vacuum retrieval of the soiled fluid. This method, often referred to as "hot water extraction," applies a substantial amount of water based cleaning solution to the textiles, such as a carpet or upholstery, and uses vacuum extraction to partially remove the soil and surfactant laden cleaning solution. This process typically leaves a residual surfactant on a carpet that attracts dirt to its surface and provides a wet textile that can take many hours to completely dry. The water in the composition is known to cause rust stains if it comes into contact with iron-containing objects, as well as, to provide enhanced growing conditions for mold and other microorganisms. These deficiencies are substantially overcome by low water, powdered cleaning compositions.

The second general category of methods for cleaning textiles involves applying foam-containing solvents and surfactants to the textile followed by agitation with a brush or damp mop. Typically, the applied foam collapses after contact with the textile, and the spots and soil become less visible. While the appearance on the surface of the textile, such as a carpet, is improved, very little dirt or surfactant is actually removed. The main advantages of this method are the ability to use household tools and equipment and the rapid cleaning cycle. Canadian Patent No. 985113, assigned to Unilever Limited, shows a variation on this wherein a non-scrub foam, which contains soil retardant particles, is applied to the carpet. These soil retardant particles remain as a residue on the carpet after the other components of the foam are removed by vacuuming.

While this method can be used to improve the appearance of a carpet, it is not an effective method of removing dirt and furthermore, it leaves a substantial residue on the carpet.

The third general category of methods of cleaning textiles involves applying a solid composition that contains a solvent and a cleaning surfactant to the textile followed by agitation. Typically, the solvent is allowed to evaporate and the soiled particles are retrieved with a vacuum cleaner or removed by brushing. Powdered cleaning compositions, or other dry-type cleaning compositions, generally contain, in addition to a liquid component and surfactant component, any of a rather wide variety of both natural and synthetic solid particulate materials. Natural solid particulate materials include, for example, buckwheat flour (see U.S. Pat. No. 2,165,586 to Studer), wood flour, and diatomaceous earth of specific particle size and low bulk density (see U.S. Pat. No. 3,418,243 to Hoxie). Synthetic solid particulate materials include, for example, polymeric materials such as polyurethanes, polystyrenes and phenolformaldehyde resin particles, as disclosed, for example, in French Patent No. 2,015,972. Several examples of powdered cleaning compositions are discussed below.

U.S. Pat. No. 4,013,594 to Froehlich, et al. discloses a powdered cleaning composition that contains, as a major component, solid polymeric urea-formaldehyde particles and a solvent component which may be chosen from water, high boiling hydrocarbon or chlorinated hydrocarbon solvents, aliphatic alcohols and mixtures of such compounds.

U.S. Pat. No. 4,108,800 to Froehlich discloses a semi-dry powdered cleaning composition which further contains polyethylene glycol as an aid to prevent the adherence of fine particles to the fibers being cleaned. This reference further describes the visual problem of "frosting" that occurs when small particles are formed from particle to particle attrition as a result of agitation, such as brushing.

U.S. Pat. No. 4,194,993 to Deal discloses a process for making a powdered cleaning composition which includes the steps of polymerizing urea and formaldehyde in acidic solution to form particles of a desired size, centrifuging the particles, blending polyethyleneoxide into the polymer, and spraying a fine mist of detergent solution onto the polymer mass as it is blended.

U.S. Pat. No. 4,434,067 to Malone, et al. discloses a powdered cleaning composition that contains, in addition to a particulate polymeric material such as urea formaldehyde, an inorganic salt adjuvant and an aqueous or organic fluid component. The Examples and the Tables illustrate that the maximum content of fluid in these powdered cleaning compositions as 40% of the total composition. They further describe the formation of pastes and non-flowable solids when the liquid level or the inorganic salt adjuvant component represents too high a proportion of the total composition.

U.S. Pat. No. 4,802,997 to Fox, et al. discloses a polymer gel cleaning composition that may be sprinkled on a carpet wherein the polymer is insoluble in water yet highly swellable with water. This composition is sponge-like in that it is capable of ejecting solvent under mechanical pressure or brushing and then reabsorbing the solvent when the mechanical pressure or brushing is removed. The pea-sized particles can be removed by vacuuming, even if the solvent has not yet evaporated. The polymers suitable for hydrogel formation can absorb 0.3 to 300 times their weight in water. The swollen gels can be blended with calcium carbonate or wood powder to improve flow characteristics.

U.S. Pat. No. 4,659,494 to Soldanski, et al. describes a cellulose powder containing dry carpet cleaner with reduced dusting, particularly if the carpet cleaner did not contain added surfactant.

U.S. Pat. No. 4,908,149 to Moore, et al. discloses improved carpet cleaning compositions that include acid dye stain blocker additives. These compositions range from particle free solutions to dry-type powders with a minimum of 30% solid particle content.

U.S. Pat. No. 4,873,000 to Weller discloses a powdered freshening and deodorizing composition for carpets. The composition contains inorganic salts in combination with aluminum silicate clay to improve vacuum retrieval. The composition further contains a maximum of 4% liquid comprised of fragrance and organic agglomerating agent.

EP 1,063,282 B1 to Lang, et al. discloses a cellulose-based, porous, particle gel carpet cleaning composition in combination with water and alcohol. This composition remains in the gel state even in the presence of an 80% water and alcohol mixture.

U.S. Pat. No. 5,783,543 to Fleckenstein discloses a scatterable powdered cleaning composition incorporating viscose sponge flakes from 3 to 10 mm in length. The improved composition results in less disruption of the carpet fibers due to the brushing process.

EP 1184449 to Gagliardi, et al. describes a solid cleaning composition with low water content that is particularly useful for cleaning wet spills. The composition incorporates water swellable polymers and anhydrous salts to absorb liquid and turn wet spills into powders that can be removed by vacuum cleaners. The cleaning of wet spills by conventional powdered cleaning agents is problematic due to the potential to form pastes that are not vacuum retrievable.

U.S. Pat. No. 6,569,210 to Chao, et al. describes a novel fabric cleaning method whereby soils are treated with a particulating chemical, such as a colorless sulfonated dye site blocker, to generate particles that are then removed by gas jet interaction.

U.S. Pat. No. 6,010,539 to Pesco discloses a modern example of cleaning compositions for hot water extraction systems. This composition is free of organic solvents and contains water, detergent builders (such as sodium tripolyphosphate), EDTA, non-ionic surfactants, stain soluble resist polymers (such as methacrylic acid salts) and a fluorosurfactant.

There have been a few previous attempts by others to create textile cleaning methods and compositions that use liquid or paste systems with particles and solvent. These are briefly described below.

U.S. Pat. No. 3,910,848 to Froehlich et al. discloses a cleaning formulation that comprises a halogenated solvent and urea formaldehyde polymer particles as major components. The composition further contains small amounts of an antistatic agent and an anti-settling agent and optionally, a chlorofluorinated propellant for aerosol applications. The high liquid density of the halogenated solvent helps to suspend the particles but its human and ecological impact make it undesirable for consumer use. The reference fails to recommend or suggest the use of water as a solvent.

U.S. Pat. No. 3,956,162 to Lautenberger describes a thixotropic cleaning paste for cleaning non-horizontal surfaces. The paste contains particles with oil absorption values above 90, minor amounts of water, both low and high boiling hydrocarbon or halogenated hydrocarbon solvents, surfactant, silica (to provide thixotropic flow characteristics), and various other additives. This composition dries to apparently free flowing particles that can be removed by vacuuming or brushing. This thick composition is not suitable for spraying and contains either the undesirable flammability of hydrocarbon solvents or the undesirable health effects of halogenated solvents.

U.S. Pat. No. 4,685,930 to Kasprzak describes a cleaning method of applying liquid cyclic siloxane solvents to soiled textiles and then removing the solvents and dirt by blotting with absorbent paper towels. Alternatively, a solid mixture of cyclic siloxane solvent and an absorbent material selected from mineral particulates, organic particulates, and synthetic porous polymers may be applied to the soiled textile and subsequently removed by brushing or vacuuming. Method claims directed to absorbent particles are limited to cyclic siloxane solvents and stains derived from oil, grease, or sebum.

U.S. Pat. No. 5,259,984 to Hull describes a water-containing polymer cleaning solution that contains a volatile alcohol and a polyamine. This gel or lotion-like solution is spread over the carpet or upholstery, allowed to thicken by evaporation, and then rubbed into soft absorbent polymer gel balls that absorb dirt which may then be removed by brushing or vacuuming. This method seems well suited to rinse-free cleaning of hands, where rubbing and brushing is effective, but is of questionable utility on textile products where the gel may be entrapped within the textile structure and where a fully dried polymer solution may prove intractable.

Finally, in US Patent Application No. 2003/0092589 and related US Patent Application No. 2003/0109399 to Todini et al. a liquid nanolatex and surfactant containing composition and method of cleaning carpets is disclosed. Due to the small size of the nanolatex particles, the particles form suspensions in water. It is further disclosed that upon drying, the nanolatex particles agglomerate and can be removed by vacuum methods. The soil removal index in the table on page 7 of both applications shows several examples of cleaning compositions without illustrating a clear advantage over vacuuming alone.

Thus, as is illustrated by the previous efforts of others, the use of solid cleaning agents for carpet or upholstery has been recognized as the superior method of cleaning. Its low water content allows both for rapid drying and safe cleaning of even expensive wool carpets. The hand application (i.e. sprinkling and spraying methods) and brushing followed by retrieval using the household vacuum cleaner requires no specialized machinery. The particles absorb both sticky soils and residual surfactants so that the textile remains cleaner much longer. In addition, solid cleaning agents have been established to effectively remove allergens, while not promoting the growth of micro-organisms.

There are, however, limitations to the use of solid cleaning agents. The solid cleaning agents may be characterized by the classical Critical Pigment Volume (CPV) effect. The CPV is also known as the oil value, which may be determined by ASTM D281 and which is described, for example, in U.S. Pat. No. 3,956,162 to Lautenberger. To remain a flowable powder, the maximum liquid content is restricted to below the CPV. For particles of a certain shape, the CPV is the volume between particles filled with air. As the air is displaced by a fluid, the flow properties of the powder are reduced until, at the CPV, all the particles are surrounded by liquid. At that point, the mass has the consistency of putty. If more fluid is added, the putty gradually thins until a paint-like dispersion is generated. The practical problem of prior art solid cleaning compositions is that when wet spills are cleaned with powdered cleaning agents, it is possible to generate a paste consistency that, when brushed, does not remain free flowing.

This creates a spot that is very difficult to remove. In addition, if brushing occurs at the thick dispersion or paste stage the particle size can be mechanically reduced by particle to particle attrition. Particles having a particle size of less than about 5 microns are held very tightly by electrostatic force and are very difficult to remove by vacuum cleaners. This also leads to an observable residual spot of cleaner on the textile. Therefore, there is the need to provide a solid containing cleaning composition that avoids the practical side effects of the Critical Pigment Volume.

Another limitation of powdered cleaning agents falls into the area of consumer and market perception. Consumers have continued to greatly prefer hot water extraction due to their perception that water and soap are needed to really clean surfaces. Most consumers bathe, clean clothes, clean dishes, and clean hard surfaces with soap and water. There is, therefore, a need to provide a water and soap like cleaning agent without the negative properties of rapid resoil, promotion of microbial growth, and water damage to expensive carpets and other textiles.

Another limitation of powdered cleaning agents and other prior art cleaning methods is the number of steps required to complete the cleaning cycle. For example, the procedure for using the Capture® dry cleaning product, available from Milliken & Company of Spartanburg, S.C., includes the steps of: (1) applying a water based premist solution to the carpet, (2) broadcasting the Capture® dry cleaning composition, (3) brushing the cleaning the composition into the carpet, (4) allowing the product to dry for 30 minutes, and (5) retrieving the soil laden powder using a vacuum cleaner. In comparison, the hot water extraction cleaning process preferred by consumers includes the steps of: (1) vacuuming and removing obstacles and furniture from the area to be cleaned, (2) alternating between applying detergent fluid to the carpet and vacuum extracting the soiled fluid, (3) alternating between applying rinse water and removing soiled rinse water by vacuum extraction, (4) allowing the wet carpet to dry, and (5) returning the removed furniture. Thus, there is a need to provide a cleaning composition and a cleaning method that allows fewer steps.

In summary, there is a need to provide a water-based liquid cleaning composition that dries much faster than hot water extraction systems, that does not exhibit the negative effects of Critical Pigment Volume, that does not require specialized machinery, that provides vacuum retrieval of sticky dirt and residual surfactants, that exhibits reduced resoil rates, and that provide s reduced number of steps in the cleaning cycle.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. All patents, published patent applications, and any other publications mentioned in this patent application are herein incorporated by reference.

This invention relates to compositions and methods for cleaning textile substrates, particularly carpet and upholstery fabrics. More particularly, the present invention relates to compositions that retain the advantages of dry carpet cleaning compositions. These dry carpet cleaning compositions are typically applied in a liquid form, yet they allow for vacuum removal of absorbent particles that contain oil and water based carpet stains and residual surfactants.

The inventive aqueous fluid compositions contain one or more of the following components: organic liquids, absorbent particles, surfactants, surface active agents, dispersion stabilizing additives, static reducing additives, dust suppressing additives, vacuum retrieval additives, metal ion chelators, stain resist agents, pH adjusters, fragrance, biocides, and aerosol propellants. Aerosol propellants may be utilized to assist in providing a cleaning composition that is a stable, sprayable dispersion or that is an easily redispersed (such as by shaking the composition) composition suitable for spraying. These components of the inventive aqueous fluid composition may be present in the inventive composition in any of a number of combinations, as may be determined by the specific end-use of the inventive composition.

It may be ideal that the cleaning formulation is comprised of less than about 75 parts by weight of an absorbent particulate and at least about 35 parts by weight water, wherein the water may also contain a surfactant sufficient to provide a surface tension of less than about 40 dynes per centimeter. It may be more preferable that the cleaning composition is comprised of less than about 50 parts by weight of an absorbent particulate. Further, it may be preferable that the cleaning formulation is comprised of at least 50 parts by weight water, and even more preferable, at least 75 parts by weight water, wherein the water may also contain a surfactant sufficient to provide a surface tension of less than about 40 dynes per centimeter. The other various additives and liquids that may be included in the cleaning composition, such as dispersion stabilizers, vacuum retrieval additives, organic liquids, etc., may be present in amounts from about 0.01 to about 50 parts by weight.

Examples of organic liquids which can be used include, without limitation, $C_1$ to $C_4$ aliphatic alcohols, high boiling hydrocarbon solvents, and mixtures thereof. The hydrocarbon solvents are generally the petroleum distillates with a boiling point between about 100° C. and about 300° C. Low boiling organic liquids are generally unsuitable from a standpoint of vapors and flammability, and higher boiling organic liquids do not evaporate from the carpet fibers at an adequately rapid rate. Examples of commercially available hydrocarbon solvents include Stoddard solvent and odorless hydrocarbon solvent. These solvents usually consist of a petroleum distillate with a boiling point between about 105° and about 200° C. Properties of these solvents are comparable to those of British Standard White Spirits and domestic mineral spirits. Chemically these solvents consist of a number of hydrocarbons, principally aliphatic, in the decane region. One potentially preferred, non-limiting organic liquid is a high boiling hydrocarbon solvent.

The absorbent particles may be selected from a wide variety of solid materials. The solid materials may include naturally occurring materials, such as wood particles (like sawdust or wood flour), particles made from grains and other vegetable matter, diatomaceous earth particles, cellulosic particles and inorganic particles (such as silicates, borates, etc.). The solid material may also be a synthetic material, such as a synthetic resin material. Synthetic resin materials include, for example, urea formaldehyde polymer, such as those disclosed in commonly assigned U.S. Pat. Nos. 4,434,067 and 4,908,149. Other synthetic resin materials include, for example, polyurethane, polystyrene, and phenol-formaldehyde resin particles, similar to the type disclosed in French Patent No. 2,015,972 assigned to Henkel Et Co Gmbh. Still other absorbent particles include water insoluble inorganic salt adjuvants such as, for example, sulfates, carbonates (such as calcium carbonate), borates, citrates, phosphates; metasilicates and mixtures thereof.

Average particle size of the particles may be from about 10 microns to about 300 microns in diameter as determined by sieve analysis. It may be more preferable that the average particle size of the particles is from about 10 microns to about 200 microns in diameter as determined by sieve analysis. It may be even more preferable that the average particle size of the particles is from about 10 microns to about 105 microns in diameter as determined by sieve analysis. It may yet be even more preferable that the average particle size of the particles is from about 35 microns to about 105 microns as determined by sieve analysis. In general, it may be preferable for some applications that the particle size distribution should be such that not more than about 10 percent of the particles are larger than about 105 microns and in general no more than about 5 percent of the particles are smaller than about 10 microns. Larger particles typically do not penetrate carpet material adequately, and use of such particles would result in only superficial cleaning at best. Larger particles also have insufficient surface area to absorb a large amount of soil per unit of weight. If the particles are smaller than about 10 microns in diameter, they may adhere to the individual carpet fibers and have a delustering or dulling effect on the color of the carpet. While particles between about 10 and 35 microns may be tolerated, they may not contribute to cleaning efficiency to any substantial extent so that the average particle size should be in excess of 35 microns.

As discussed previously, the absorbent particles may be characterized by the classical Critical Pigment Volume (CPV) effect, also known as the oil value or oil absorption value. This value may be determined by ASTM D281 and is described, for example, in U.S. Pat. No. 3,956,162 to Lautenberger. To remain a flowable powder, the maximum liquid content is restricted to below the oil absorption value. For particles of a certain shape, the oil absorption value is the volume between particles filled with air. As the air is displaced by a fluid, the flow properties of the powder are reduced until, at the oil absorption value, all the particles are surrounded by liquid. Accordingly, it may be preferred that the absorbent particles have an oil absorption value of at least 40. It may be more preferable that the absorbent particles have an oil absorption value of at least 60.

One potentially preferred, non-limiting solid material for use in such compositions is the type which has been disclosed in U.S. Pat. No. 4,013,594 to Froehlich, et al. wherein particulate, polymeric urea formaldehyde particles were proposed for use in dry-type cleaning compositions. These particulate urea formaldehyde materials were distinguished in the Froehlich patent from those of the earlier French Patent No. 2,015,972 based upon a fairly broad range of parameters. Of particular interest was the disclosure that the particles described in the Froehlich patent, as compared to the particles of the French patent, possessed a somewhat higher bulk density of at least about 0.2 grams per cubic centimeter. Such higher bulk density characteristics resulted in generally increased cleaning effectiveness as compared to the prior art particles.

Surfactants of a number of classes are satisfactory for use in the compositions of this invention. The selection of a surfactant is not critical but the surfactant should serve to lower the surface tension of the water in the composition to about 40 dynes per centimeter or less. Preferred anionic surfactants are long chain alcohol sulfate esters, such as those derived from $C_{10}$-$C_{18}$ alcohols sulfated with chlorosulfonic acid and neutralized with an alkali. Also preferred are alkylene oxide additives of $C_6$-$C_{10}$ mono and diesters of ortho-phosphoric acid. Representative nonionic surfactants that can be used have the formula:

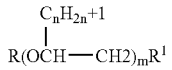

where n is 0 or 1, m is 3 to 20, $R^1$ is OH or $OCH_3$, R is $C_{12}$ to $C_{22}$ alkyl or phenyl or naphthyl optionally substituted by $C_1$ to $C_{10}$ alkyl groups.

The surfactant can be a nonionic surfactant or a mixture of a nonionic surfactant and either an anionic surfactant or a cationic surfactant. Mixtures of anionic and cationic surfactants are suitable only in carefully selected cases. A preferred composition contains from about 1 to about 4% nonionic surfactant. A satisfactory mixture of commercial anionic surfactants comprises (1) 0.4% of the sodium salt of a mixture of $C_{10}$-$C_{18}$ alcohol sulfates, predominantly $C_{12}$, (2) 0.4% of the diethylcyclohexylamine salt of the same sulfate mix, and (3) 0.2% of the product formed by reacting a mixture of n-octyl mono and diesters of ortho-phosphoric acid with sufficient ethylene oxide to form a neutral product, ordinarily about 2 to 4 moles of ethylene oxide per mole of phosphoric ester. The surfactant is normally used in amounts ranging from about 0.5 to about 5.0% by weight but useful amounts are not limited to this range.

Examples of dispersion stabilizing additives include, for example, such compounds as air, cellulosic polymers (such as hydroxyethylcellulose), starches, clay compounds, xanthan gums, polyacrylic acids and esters (such as methacrylic acid/ethyl acrylate copolymer), polyacrylamide, polyvinyl alcohol and mixtures thereof.

Vacuum retrieval additives include, for example, compounds such as polyoxyalkylene materials (such as dipropylene glycol), aluminum silicate clay, hydrolyzed styrene maleic anhydride, and mixtures thereof. Polyoxyalkylene materials (such as dipropylene glycol, as well as non-volatile organic solvents (such as mineral oil), and mixtures thereof may also be used as dust suppressing additives. Aluminum silicate clay may also be used as a static reducing additive. Metal ion chelators include such compounds, for example, as ethylene diamine tetraacetic acid (EDTA). Stain resist agents include such compounds as, for example, acrylic stain blockers. Such compounds as aqua ammonia and citric acid may be included as pH adjusters. Biocides may be included to prolong the shelf life of the cleaning composition. These may include, for example, compounds such as potassium sorbate, isothiazolones and mixtures thereof. Aerosol propellants include such compounds as propane, butane, carbon dioxide and mixtures thereof.

The textile substrate to which the composition may be applied is most preferably a carpet or upholstery fabric. As used herein, the term "carpet" is intended to include, without limitation, broadloom carpets, carpet tiles, rugs, and other textile floor covering material that may be cleaned by the compositions and methods described herein. The upholstery fabric may be woven, knitted, nonwoven, or combinations thereof. The textiles substrates may be comprised of natural fibers, synthetic fibers, or combinations thereof. Synthetic fibers include, for example, polyester, acrylic, polyamide, polyolefin, polyaramid, polyurethane, regenerated cellulose, polyvinylacetate, and blends thereof. More specifically, polyester includes, for example, polyethylene terephthalate, polytriphenylene terephthalate, polybutylene terephthalate, polylactic acid, and combinations thereof. Polyamide includes, for example, nylon 6, nylon 6,6, and combinations thereof. Polyolefin includes, for example, polypropylene, polyethylene, and combinations thereof. Polyaramid includes, for example, poly-p-phenyleneteraphthalamid (i.e., Kevlar®), poly-m-phenyleneteraphthalamid (i.e., Nomex®), and combinations thereof. Natural fibers include, for example, wool, cotton, flax, and blends thereof.

The textile substrate may be formed from fibers or yarns of any size, including microdenier fibers and yarns (fibers or yarns having less than one denier per filament). The fabric may be comprised of fibers such as staple fiber, filament fiber, spun fiber, or combinations thereof.

The cleaning composition may be applied to a carpet using a trigger, pump, or electrical sprayer, wherein said electrical sprayer is battery or power operated. This method may be well suited for spot cleaning a textile substrate. The term "spray application" or "spray-applied" is intended to encompass the application of such compositions to target fabrics through the utilization of a spray-trigger mechanism and/or device as is well known in the art. The cleaning composition may be dispensed as a continuous stream or as a spray of droplets. Such a mechanism and/or device provides an effective manner of uniformly dispersing droplets of the composition over a relatively broad surface area of a target substrate. Thus, atomization, droplet formation and application on an even basis, and other non-limiting and similar spraying techniques are encompassed by such a term. It is also contemplated that the cleaning composition could be poured from the spray bottle to clean a textile substrate.

There are various well-known types of sprayers available, and several examples are disclosed in the Examples section below. Some are known as finger sprayers, which may have a spray orifice of about 0.1 mm to about 0.8 mm in diameter. Others, such as trigger sprayers, may have a spray orifice of about 0.4 mm to about 1.0 mm in diameter. Common pump up and electric sprayers may have a spray orifice measuring, on average, 0.02 inches in diameter. The method itself may also require a simple agitation, such as by rubbing or brushing, of the target fabric surface after spray application in order to work the composition into the soiled substrate surface. The cleaning composition may then be retrieved from the substrate either by immediate vacuuming or by a later vacuuming.

Alternatively, the cleaning composition may be applied to the textile substrate via a squeezable packaging container. This method may also be well suited for spot cleaning a textile substrate. The size of the container may be such that the interior volume of the container will typically hold less than about one gallon of cleaning composition. Such a container may have a removable screw cap or a flip cap at one end for dispensing the cleaning composition. The cap may also have a synthetic applicator tip at one end comprised of a plurality of synthetic bristles, foam, or other scrubbing mechanism. A synthetic cover may also be provided which serves to encase the applicator tip when not in use. The applicator tip may have an opening which allows the cleaning composition to be dispensed from within the container when pressure is applied to the container. The opening may have a diameter of about 0.5 mm to about 5.0 mm. Once the cleaning composition has been applied to the textile substrate, the bristles of the applicator tip may serve as an agitating tool for brushing or rubbing the composition into the soiled textile substrate surface. As in the spray application method, the cleaning composition may then be retrieved from the substrate either by immediate vacuuming or by a later vacuuming.

Yet another application method includes applying the cleaning composition to a textile substrate, particularly a carpet or upholstery fabric, using a carpet cleaning machine. The carpet cleaning machine may be a hot water extraction machine, a bonnet machine, or a foaming machine. The carpet cleaning machine may be electrical powered, battery powered, or it may be a mechanical carpet cleaning device that his powered by human effort similar to a kitchen mop. This application method may be well suited for residential or commercial carpet cleaning needs. The cleaning composition may be contained in a holding tank that is mounted on the vertical handle of a traditional carpet cleaning machine. The holding tank may include a stirring mechanism inside the tank which allows for continuous stirring of the composition contained therein. A dispensing lever, attached to the horizontal handle of the machine, may be used to dispense the cleaning composition from the holding tank. Suitable tubing materials may be used which is connected to an opening in the bottom of the holding tank and extends vertically downward to the rotating brushes located on the bottom of the carpet cleaning machine.

The cleaning composition, when mechanically released from the holding tank by the dispensing lever, enters the tubing at this opening and, due to gravity, descends downward to the scrubbing mechanism located on the underside of the carpet cleaning machine. The scrubbing mechanism for electrical or battery powered machines may include rotating brushes. The scrubbing mechanism for the mechanical, mop-like cleaning machines may include abrasive foam sponges or other any other material which will act as to work the cleaning composition into the soiled surface. The cleaning composition descends downward to the scrubbing mechanism until the tubing terminates and the cleaning composition is dropped onto the substrate. The rotating brushes will then gentle work the composition into the soiled surface of the substrate, and then the composition may be retrieved immediately or at a later time via vacuuming.

Various embodiments of the invention are shown by way of the Examples below, but the scope of the invention is not limited by the specific Examples provided herein.

EXAMPLES

The following Examples further illustrate the present cleaning formulation but are not to be construed as limiting the invention as defined in the claims appended hereto. All parts and percents given in these examples are by weight unless otherwise indicated.

Textile Substrates:

Various carpet and fabric substrates, as described below, were used to test the inventive cleaning compositions and methods.

Carpet A-1:

This carpet is a dark blue color commercial grade 18" cut pile carpet tile (available from Milliken & Company of Spartanburg, S.C., Patter #542903). The carpet was a cushion back construction of 100% nylon face fiber.

Carpet A-2:

This carpet is a light tan commercial grade 18" cut pile carpet tile (available from Milliken & Company of Spartanburg, S.C., Pattern #542903). The carpet was a cushion back construction of 100% nylon face fiber.

Carpet B:

This carpet is an off white residential top grade broadloom carpet (available from Shaw, Profusion product). The carpet was constructed of 100% nylon face fiber. The carpet had a fluorocarbon treatment on its surface.

Carpet C:

This carpet was an almond colored builder grade broadloom carpet (available from Mohawk, Commander product). The carpet was constructed of 100% nylon face fiber. The carpet had no fluorocarbon treatment on its surface.

Carpet D:

This carpet was a dark blue commercial grade 18" cut pile carpet tile (available from Milliken & Company, Pattern #542903). The carpet was a cushion back construction of 100% nylon face fiber.

Carpet E:

This carpet was a white, cut loop pile broadloom carpet (available from Milliken & Company). The carpet was comprised of 100% nylon face fiber.

Fabric A:

This fabric was a 100% cotton oxford flat weave fabric (available from Milliken & Company).

Examples 1-9

Various liquid carpet cleaning compositions containing particles suspended in a solvent, in a slurry form, were produced for cleaning residential and commercial carpet substrates. The formulations and procedures are described below.

I. Formulations

Example 1

The formulation was prepared by placing 30 parts of water and a blend of the remaining 60 parts of the other "dry" ingredients (listed below in Table 1) into the stainless steel bowl of a KitchenAid ProLine mixer having the whisk attachment in place. The mixer was turned to a setting of 2 and allowed to run for 2 minutes. The result was a stable, frothy foam.

Carpet A-2 was spot stained according to the Spot Cleaning Test Procedure described below. The formulation of Example 1 was then applied to Carpet A-2. The stable, frothy foam remained on the surface and was easily hand brushed into the carpet. The results showed that, by visual evaluation, the formulation of Example 1 removed the stain spots when compared with the control carpet. The results also indicate that air may be incorporated into the cleaning formulation as a dispersion stabilizing additive, via a wire whisk attachment on a mixer, to create a foam that can then be transferred to a textile substrate for cleaning purposes.

TABLE 1

Example 1 Formulation

| Component | Amount (parts) |
|---|---|
| Urea Formaldehyde Polymer ("UFP", as described in U.S. Pat. No. 3,910,848) (35-40% moisture content) | 44 |
| Calcium Carbonate (inorganic salt) | 21 |
| Water | 30.4 |
| Triton XL 80 N (a nonionic surfactant available from Rohm and Haas) | 2.4 |
| MilliGard NYS (an acrylic stain resist agent available from Milliken Chemical) | 1.0 |

TABLE 1-continued

Example 1 Formulation

| Component | Amount (parts) |
|---|---|
| Potassium Sorbate (a biocide) | 1.0 |
| Kathon (an isothiazolone biocide available from Rohm and Haas) | 0.1 |
| Fragrance | 0.1 |

Example 2

The formulation was prepared according to the same procedure described previously in Example 1 using the components shown below in Table 2.

Carpet A-2 was spot stained according to the Spot Cleaning Test Procedure described below. The formulation of Example 2 was then applied to Carpet A-2. The stable, frothy foam remained on the surface and was easily hand brushed into the carpet. The results showed that, by visual evaluation, the formulation of Example 2 removed the stain spots when compared with the control carpet. The results also indicate that air may be incorporated into the cleaning formulation as a dispersion stabilizing additive, via a wire whisk attachment on a mixer, to create a foam that can then be transferred to a textile substrate for cleaning purposes.

TABLE 2

Example 2 Formulation

| Component | Amount (parts) |
|---|---|
| UFP (35-40% moisture content) | 44 |
| Calcium Carbonate (an inorganic salt) | 21 |
| Water | 31.2 |
| Triton XL 80 N (a nonionic surfactant) | 2.4 |
| Potassium Sorbate (a biocide) | 1.0 |
| Kathon (a biocide) | 0.1 |

Example 3

The formulations for Examples 3A-3E were prepared following the procedure for Example 1 using the components shown in Table 3 below. The mixer was turned to a setting of 2 and allowed to run for 2 minutes. The result was a stable, frothy foam.

Example 3F was also prepared following the procedure for Example 1 using the components shown in Table 3 and by using a stream of air, instead of a whisk, to incorporate air into the formulation as a dispersion stabilizing additive and generate the foam. The resulting foam flowed over the walls of the container. The foam was stable for several minutes before collapsing. After the foam collapsed and dried, there was residual powder present that confirmed that the powder could be transported from a tank and delivered to a textile substrate surface (such as a carpet) by a foaming mechanism.

Carpet A-2 was spot stained according to the Spot Cleaning Test Procedure described below. The formulations of Examples 3A-3E were then applied to Carpet A-2. The stable, frothy foam remained on the surface and was easily hand brushed into the carpet. The results showed that, by visual evaluation, the formulations of Examples 3A-3E removed the stain spots when compared with the control carpet.

TABLE 3

Example 3 Formulations (Amounts are in parts)

| Component | 3A | 3B | 3C | 3D | 3E | 3F |
|---|---|---|---|---|---|---|
| UFP (35-40% moisture content) | 39.5 | 39 | 40 | 42.4 | 25.8 | 17 |
| Water | 49.5 | 49.5 | 50 | 57.4 | 72.9 | 82 |
| MilliGard NYS (an acrylic stain resist agent) | 10 | 10 | 0.8 | 0 | 1.0 | 0.8 |
| Triton XL 80 N (a nonionic surfactant) | 1 | 0 | 0.2 | 0.2 | 0.3 | 0.2 |
| Sodium Lauryl Sulfate (an anionic surfactant) | 0 | 1.5 | 0 | 0 | 0 | 0 |

Example 4

The formulation was prepared by placing water and a blend of the remaining parts of the other "dry" ingredients (listed below in Table 4) into the stainless steel bowl of a KitchenAid ProLine mixer having the kneading attachment in place. The mixer was turned to a setting of 2 and allowed to blend the ingredients for 5 minutes. Then 20 parts of Example 4 was packaged with 80 parts of water into an aerosol can having a propane/butane mixture as the propellant. When the solution was discharged from the can onto the surface of a carpet the resulting foam did not collapse until after 2-3 minutes had elapsed.

Carpet B was spot stained according to the Spot Cleaning Test Procedure described below. The formulation of Example 4 was then applied to Carpet B. The stable, frothy foam remained on the surface and was easily hand brushed into the carpet. The results showed that, by visual evaluation, the formulation of Example 4 removed the stain spots when compared with the control carpet. The results also show that including an aerosol propellant in the formulation is an effective means of creating a dispersion which could be easily applied to the surface of a textile substrate.

TABLE 4

Example 4 Formulation

| Component | Amount(in grams) |
|---|---|
| UFP (35-40% moisture content) | 55.5 |
| Water | 44.4 |
| Erionyl NYB (an acrylic stain blocker) | 0.09 |
| Hydroxy Ethyl Cellulose (a dispersion stabilizing additive) | 0.01 |

Example 5

The formulations for Examples 5A-5D were prepared by adding the appropriate amount of water and other liquid ingredients, as shown in Table 5 below, into a breaker equipped with a magnetic stir bar. Once the solution was allowed to stir, the remaining ingredients were added and agitated for 2 minutes. The particles quickly settled out of solution over a 1-2 minute period.

Carpet A-2 was tested for cleaning efficiency according to the Cleaning Efficiency Test Procedure described below. The formulations of Examples 5A-5D were then applied to Carpet A-2 using a trigger sprayer (Calmar item # TS 800, AFA Dispensing Co Ratchett QAIII, AFA Dispensing Co. item #5910BT) while the solution was continuously stirred. A stable dispersion was formed and was easily hand brushed into the carpet. The cleaning efficiency results of each of the formulations was compared with: (a) samples treated with water only ("Control"), (b) samples cleaned using Capture powder and Pre-Mist Spray (both available from Milliken & Company), and (c) samples treated with a Hoover Steam Vac Prosteam carpet cleaning machine and the cleaning chemicals recommended for use in the machine (performed according to AATCC 171-97 Test Method for hot water extraction of cleaning carpets). The results are shown in Table 5R-1 below.

The formulation of Example 5C was also applied to Carpet B and Carpet C. The cleaning solution was applied to the carpet using the Calmar trigger sprayer while the solution was continuously stirred. The results showed that, by visual evaluation, the formulation of Example 5C removed the stain spots when compared with the control carpet.

The formulation of Example 5C was also applied to Carpet C using an Aerus Floor Pro Encore Shampooer/Polisher machine which gravity fed the solution to the carpet while the dispersion was continuously circulated in a holding tank attached to the handle of the machine. Subsequent testing of the carpet was performed according to the Cleaning Efficiency Test Procedure; however, the results were rated using the visual analysis technique for the Spot Cleaning Test Procedure. The results are shown in Table 5R-2 below.

The formulation of Example 5C was also applied to Carpet B and Carpet C using a Hoover Steam Vac Prosteam carpet cleaning machine while the solution was continuously circulated in the holding tank. The results showed that, by visual evaluation, the formulation of Example 5C removed the stain spots when compared with the control carpet. The results also indicate that the inventive cleaning compositions may successfully be applied to a textile substrate via a carpet cleaning machine.

TABLE 5

Example 5 Formulations (Amounts are in parts)

| Component | 5A | 5B | 5C | 5D |
|---|---|---|---|---|
| UFP (dry weight) | 2.00 | 10.00 | 20.00 | 40.00 |
| Water | 96.829 | 88.956 | 79.084 | 59.262 |
| Styrene Maleic Anhydride (vacuum retrieval additive) | 0.88 | 0.79 | 0.692 | 0.558 |
| Aqua Ammonia (pH adjuster) | 0.02 | 0.016 | 0.014 | 0.011 |
| Sodium Lauryl Sulfate (an anionic surfactant) | 0.20 | 0.172 | 0.152 | 0.122 |
| Propylene Glycol t-butyl ether (an organic liquid) | 0.07 | 0.065 | 0.057 | 0.046 |
| Fragrance | 0.001 | 0.001 | 0.001 | 0.001 |

TABLE 5R-1

Example 5 Cleaning Efficiency Results

| Sample | Amount of Formulation Added to Tile (g) | Ls After Soiling | Lo Original | Lc After Cleaning | % Cleaning Efficiency | Average % Cleaning Efficiency |
|---|---|---|---|---|---|---|
| Control 1 | 1.42 | 55.855 | 60.644 | 57.699 | 38.50 | |
| Control 2 | 1.62 | 55.204 | 60.62 | 57.19 | 36.67 | |
| Control 3 | 1.61 | 54.77 | 60.157 | 56.781 | 37.33 | 38 |
| Example 5A-1 | 1.47 | 55.735 | 60.2 | 58.546 | 62.96 | |
| Example 5A-2 | 1.57 | 55.995 | 60.52 | 58.698 | 59.73 | |
| Example 5A-3 | 1.73 | 56.19 | 60.537 | 58.667 | 56.98 | 60 |
| Example 5B-1 | 1.59 | 55.565 | 60.608 | 58.741 | 62.98 | |
| Example 5B-2 | 1.62 | 55.474 | 60.672 | 58.13 | 51.10 | |
| Example 5B-3 | 1.54 | 55.367 | 60.141 | 58.244 | 60.26 | 58 |
| Example 5C-1 | 1.52 | 55.454 | 60.553 | 59.086 | 71.23 | |
| Example 5C-2 | 1.52 | 55.015 | 60.828 | 58.965 | 67.95 | |
| Example 5C-3 | 1.51 | 54.925 | 60.529 | 58.686 | 67.11 | 69 |
| Example 5D-1 | 2.08 | 55.417 | 60.33 | 58.876 | 70.41 | |
| Example 5D-2 | 1.42 | 55.027 | 60.644 | 58.782 | 66.85 | |
| Example 5D-3 | 1.42 | 54.89 | 60.675 | 59.14 | 73.47 | 70 |
| Capture ® Powder and Pre-Mist Spray 1 | N/a | 55.232 | 60.35 | 59.193 | 77.39 | |
| Capture ® Powder and Pre-Mist Spray 2 | N/a | 55.505 | 60.445 | 58.354 | 57.67 | |
| Capture ® Powder and Pre-Mist Spray 3 | N/a | 54.874 | 60.251 | 57.674 | 52.07 | 62 |
| Hoover Steam Vac 1 | 2.15 | 54.762 | 60.492 | 56.067 | 22.77 | |
| Hoover Steam Vac 2 | 0.82 | 54.837 | 60.535 | 56.052 | 21.32 | |
| Hoover Steam Vac 3 | 1.25 | 54.648 | 60.263 | 55.686 | 18.49 | 21 |

"N/a" indicates that data was not available.

The test results above indicate that these inventive cleaning compositions, while requiring continuous stirring or circulation, clearly provide greater average cleaning efficiency for a textile substrate, such as a carpet, when compared with other commercially available cleaning compositions and methods. The comparative compositions include both dry (Capture® Powder) cleaning compositions and hot water extraction cleaning systems (Hoover Steam Vac). The results also indicate that the inventive cleaning compositions provide far superior average cleaning efficiency for a textile substrate, such as a carpet, when compared with hot water extraction cleaning systems (Hoover Steam Vac).

TABLE 5R-2

Example 5 Cleaning Results

| Sample | Visual Evaluation | Average of Visual Evaluation Results |
|---|---|---|
| Example 5C in Aerus machine - 1 | 3.5 | |
| Example 5C in Aerus machine - 2 | 3.5 | |
| Example 5C in Aerus machine - 3 | 3.5 | 3.5 |
| Hoover Steam Vac - 1 | 3.1 | |
| Hoover Steam Vac - 2 | 3.1 | |
| Hoover Steam Vac - 3 | 3.1 | 3.1 |
| Capture ® Powder & Premist Spray - 1 | 3.0 | |
| Capture ® Powder & Premist Spray - 2 | 3.0 | |
| Capture ® Powder & Premist Spray - 3 | 3.0 | 3.0 |

The results showed that, by visual evaluation, the formulation of Example 5C removed the stain from the soiled carpet much better than the Capture® Powder & Premist Spray combination. The formulation performed slightly better than the hot water extraction system (using a Hoover Steam Vac machine with the recommended Hoover chemicals). The results also indicate that the inventive compositions may successfully be applied to a soiled textile substrate via a carpet cleaning machine.

Example 6

The formulations for Examples 6A-6D were prepared by adding the appropriate amount of water, as shown in Table 6 below, into a breaker equipped with an overhead stir motor with a Cowles blade attached. The agitator was adjusted to 500-700 rpm. The Laponite RD was slowly charged over a 10 minute period. The solution was heated to 50-60 degrees C. and Pluronic L65 LF was slowly added over a 10 minute period. The heat source was turned off and the UFP was slowly added over a 15-20 minute period. The resulting mixture was a stable dispersion wherein the particles did not settle out over a period of time from between 2-3 hours and up to several days. Therefore, the solutions did not require continuous agitation to prevent the particles from settling. The formulations were sprayable through both ordinary and commercially available trigger (Calmar sprayer, described previously) and finger sprayers (available from Seaquist, Sea Spray sprayer).

Carpet B was spot stained according to the Spot Cleaning Test Procedure described below. The formulation of Example 6B was then applied to Carpet B. The results showed that, by visual evaluation, the formulation of Example 6B removed the stain spots when compared with the control carpet.

TABLE 6

Example 6 Formulations (Amounts are in parts)

| Component | 6A | 6B | 6C | 6D |
|---|---|---|---|---|
| UFP (dry weight) | 15 | 15 | 15 | 15 |
| Water | 82.5 | 82.0 | 81.5 | 81.0 |
| Laponite RD (clay dispersion stabilizing additive) | 1.0 | 1.5 | 2.0 | 2.5 |
| Pluronic L65 LF (surfactant) | 1.5 | 1.5 | 1.5 | 1.5 |

Example 7

The procedure for Example 6 was followed to create the formulations for Examples 7A-7G. Examples 7D-F include commercially available carpet cleaning particles in the formulations. The components for each Example are shown below in Table 7. The formulations of Examples 7A-7G formed stable dispersions that were easily hand brushed into a carpet.

TABLE 7

Example 7 Formulations (Amounts are in parts)

| Component | 7A | 7B | 7C | 7D | 7E | 7F | 7G |
|---|---|---|---|---|---|---|---|
| UFP (dry weight) | 15 | 0 | 0 | 0 | 0 | 0 | 0 |
| Water | 82 | 82 | 82 | 82 | 82 | 82 | 82 |
| Laponite RD (clay dispersion stabilizing additive) | 1.5 | 1.5 | 1.5 | 1.5 | 1.5 | 1.5 | 1.5 |
| Pluronic L65 LF (surfactant) | 1.5 | 1.5 | 1.5 | 1.5 | 1.5 | 1.5 | 1.5 |
| Calcium Carbonate (an inorganic salt) | 0 | 15 | 0 | 0 | 0 | 0 | 0 |
| SolkaFloc 100 (cellulosic particles) | 0 | 0 | 15 | 0 | 0 | 0 | 0 |
| Host white (cellulosic particles) | 0 | 0 | 0 | 15 | 0 | 0 | 0 |
| Resolve ® High Traffic (cellulosic particles) | 0 | 0 | 0 | 0 | 15 | 0 | 0 |
| Duo P (a European particulate urethane foam) | 0 | 0 | 0 | 0 | 0 | 15 | 0 |
| Diatomaceous earth particles | 0 | 0 | 0 | 0 | 0 | 0 | 15 |

TABLE 7R

Example 7 Cleaning Efficiency Results

| Sample | Amount of Formulation Added to Tile (g) | Ls After Soiling | Lo Original | Lc After Cleaning | % Cleaning Efficiency | Average % Cleaning Efficiency |
|---|---|---|---|---|---|---|
| Capture ® powder 1 | 4.33 | 54.203 | 63.819 | 59.349 | 53.51 | |
| Capture ® powder 2 | 4.02 | 54.236 | 64.159 | 58.986 | 47.87 | |
| Capture ® powder 3 | 4.13 | 54.379 | 63.861 | 59.281 | 51.70 | 51 |
| Example 7A-1 | 4.35 | 54.596 | 64.129 | 59.11 | 47.35 | |
| Example 7A-2 | 4.52 | 55.639 | 64.631 | 60.44 | 53.39 | |
| Example 7A-3 | 4.44 | 55.265 | 64.393 | 59.606 | 47.56 | 49 |
| Example 7B-1 | 4.11 | 55.337 | 64.546 | 59.523 | 45.46 | |
| Example 7B-2 | 4.26 | 54.886 | 64.11 | 60.024 | 55.70 | |
| Example 7B-3 | 4.32 | 55.946 | 64.461 | 60.715 | 56.01 | 52 |
| Example 7C-1 | 4.36 | 56.218 | 64.226 | 63.192 | 87.09 | |
| Example 7C-2 | 4.28 | 56.542 | 64.241 | 62.798 | 81.26 | |
| Example 7C-3 | 4.31 | 56.659 | 64.39 | 63.228 | 84.97 | 84 |
| Example 7D-1 | 4.40 | 55.946 | 64.441 | 62.443 | 76.48 | |
| Example 7D-2 | 4.44 | 55.404 | 64.275 | 62.411 | 78.99 | |
| Example 7D-3 | 4.52 | 55.851 | 64.303 | 63.012 | 84.73 | 80 |
| Example 7E-1 | 4.08 | 55.978 | 64.349 | 56.75 | 9.22 | |
| Example 7E-2 | 4.21 | 56.181 | 64.491 | 57.368 | 14.28 | |
| Example 7E-3 | 4.13 | 55.992 | 64.421 | 56.989 | 11.83 | 12 |
| Example 7F-1 | 4.09 | 55.132 | 64.14 | 57.22 | 23.18 | |
| Example 7F-2 | 4.40 | 56.083 | 64.366 | 58.379 | 27.72 | |
| Example 7F-3 | 4.48 | 56.146 | 64.452 | 58.472 | 28.00 | 26 |
| Example 7G-1 | 4.08 | 55.792 | 64.226 | 60.232 | 52.64 | |
| Example 7G-2 | 4.22 | 55.616 | 64.266 | 61.207 | 64.64 | |
| Example 7G-3 | 4.35 | 56.3 | 64.287 | 62.614 | 79.05 | 65 |

Carpet A-2 was tested for cleaning efficiency according to the Cleaning Efficiency Test Procedure described below. The formulations of Examples 7A-7G were then applied to Carpet A-2 using a flip cap lotion bottle. The cleaning efficiency results of each of the formulations was compared with a sample treated with Capture® powder. The results are shown in Table 7R below.

The test results above indicate that the inventive cleaning compositions very good average cleaning efficiency for a textile substrate, such as a carpet, when compared with other commercially available cleaning compositions and methods. The comparative compositions include both dry (Capture® Powder) cleaning compositions and liquid formulations containing competitive carpet cleaning products, such as Resolve® High Traffic and Duo P. Without being bound by theory, it is believed that the formulations of Examples 7C and 7D performed so well due to the highly absorbent nature of the particles included in the formulations and the resulting ability to absorb more of the stain from the substrate. Further, and without being bound by theory, it is believed that the formulations of Examples 7E and 7E may have performed less optimally due to large particle size of the particulate material used in the formulations. These large particles likely have less surface area for absorbing stain from the substrate, thereby providing less cleaning efficiency.

Example 8

The procedure for Example 6 was followed to create the formulations for Examples. 8A-8D. The components for each Example are shown below in Table 8. The formulations for Examples 8A-8D formed stable dispersions that were easily hand brushed into a carpet.

Carpet A-2 was spot stained according to the Spot Cleaning Test Procedure described below. The formulations of Examples 8A-8D were then applied to Carpet A-2. A white towel was used to hand brush Examples 8A-8D, while a Capture® brush was used to hand brush the comparative Capture® powder. Hot water extraction ("HWE") was also performed on a comparative example using a Hoover Steam Vac Prosteam carpet cleaning machine, according to AATCC 171-97 Test Method for hot water extraction of cleaning carpets. The results are shown in Table 8R below.

TABLE 8

Example 8 Formulations (Amounts are in parts)

| Component | 8A | 8B | 8C | 8D |
|---|---|---|---|---|
| UFP (dry weight) | 15 | 15 | 15 | 15 |
| Water | 80.5 | 75.2 | 75.2 | 75.2 |
| Laponite RD (clay dispersion stabilizing additive) | 1.5 | 1.5 | 1.5 | 1.5 |
| Pluronic L65 LF (surfactant) | 1.5 | 1.5 | 1.5 | 1.5 |
| Dipropylene Glycol (a vacuum retrieval additive) | 1.5 | 1.5 | 1.5 | 1.5 |
| Ethanol (an organic liquid) | 0 | 2.3 | 0 | 0 |
| Isopropyl Alcohol (an organic liquid) | 0 | 0 | 2.3 | 0 |
| Mineral Oil (a dust suppressing additive) | 0 | 0 | 0 | 2.3 |

The results show that all of the inventive formulations 8A-8D performed very well in removing the stains (lower values illustrate more complete stain removal). The inventive formulations each exhibited approximately the same degree of removal of the stains. However, there was a noticeable difference in the removal of the French salad dressing stain. The formulations containing ethanol (Example 8B), isopropyl alcohol (Example 8C), and mineral oil (Example 8D) totally removed the French salad dressing stain, thereby illustrating, for example, the benefit of including an organic liquid in the cleaning composition. Capture® powder did not remove the stains as well as the inventive formulations. The hot water extraction performed poorly, with little to no stain removal.

Example 9

The procedure for Example 6 was followed to create the formulations for Examples 9A-9F. The components for each Example are shown below in Table 9. The formulations of Examples 9A-9F formed stable dispersions that were easily applied to a carpet.

The formulations of Examples 9A-9F were applied to Carpet A-1 according to the Dusting Test Procedure described below to compare the amount residual dust or powder left after cleaning the carpet (often known as "frosting"). The results are shown in Table 9R below.

TABLE 9

Example 9 Formulations (Amounts are in parts)

| Component | 9A | 9B | 9C | 9D | 9E | 9F |
|---|---|---|---|---|---|---|
| UFP (dry weight) | 15 | 15 | 15 | 15 | 15 | 15 |
| Water | 82 | 81.85 | 81.25 | 79.75 | 77.5 | 75.25 |
| Laponite RD (clay dispersion stabilizing additive) | 1.5 | 1.5 | 1.5 | 1.5 | 1.5 | 1.5 |
| Pluronic L65 LF (surfactant) | 1.5 | 1.5 | 1.5 | 1.5 | 1.5 | 1.5 |
| Dipropylene Glycol (a vacuum retrieval additive) | 0 | 0.15 | 0.75 | 0 | 0 | 0 |
| Pyrax WA (aluminum silicate clay, a vacuum retrieval additive) | 0 | 0 | 0 | 2.25 | 4.5 | 6.75 |

TABLE 8R

Example 8 Spot Cleaning Results

| | Spotting Substance | | | | | | | | | | |
|---|---|---|---|---|---|---|---|---|---|---|---|
| Sample | Lipstick | French Salad Dressing | Ketchup | Cola | Shoe Polish | Grape Juice | Chocolate | Motor Oil | Butter | Coffee with cream & sugar | Average |
| Ex. 8A | 1 | 1 | 2 | 2 | 2.4 | 1 | 1 | 2 | 1 | 1.6 | 1.5 |
| Ex. 8B | 2 | 1 | 1 | 1.8 | 1.8 | 1 | 1 | 1 | 1 | 1.4 | 1.3 |
| Ex. 8C | 2 | 1 | 1 | 1 | 2.4 | 1 | 1 | 1 | 1.6 | 1.6 | 1.36 |
| Ex. 8D | 2 | 1 | 1 | 1 | 2.4 | 1 | 1 | 2 | 1.6 | 1.4 | 1.44 |
| Capture Powder | 3 | 1.8 | 3 | 1 | 2 | 1.4 | 2.2 | 3 | 2 | 1 | 2.04 |
| HWE | 5 | 5 | 5 | 4.8 | 4.4 | 4.6 | 4.4 | 5 | 3.8 | 2.4 | 4.44 |

TABLE 9R

Example 9 Dusting Test Results

| Sample | Lo Value | Lc Value | Dusting Level | Average of Dusting Level Values |
|---|---|---|---|---|
| Example 9A | 15.636 | 18.894 | 3.258 | |
| | 15.092 | 18.382 | 3.29 | |
| | 15.961 | 18.173 | 2.212 | 2.92 |
| Example 9B | 15.922 | 17.296 | 1.374 | |
| | 16.052 | 16.62 | 0.568 | |
| | 15.02 | 15.832 | 0.812 | 0.92 |
| Example 9C | 15.713 | 16.559 | 0.846 | |
| | 15.409 | 16.268 | 0.859 | |
| | 15.22 | 16.277 | 1.057 | 0.92 |
| Example 9D | 15.097 | 17.837 | 2.74 | |
| | 15.35 | 17.994 | 2.644 | |
| | 16.117 | 18.462 | 2.345 | 2.58 |
| Example 9E | 16.02 | 18.425 | 2.405 | |
| | 15.872 | 18.505 | 2.633 | |
| | 16.012 | 18.157 | 2.145 | 2.39 |
| Example 9F | 15.362 | 19.581 | 4.219 | |
| | 15.751 | 19.66 | 3.909 | |
| | 15.81 | 18.59 | 2.78 | 3.64 |

The results indicate that using a vacuum retrieval additive in the inventive cleaning formulation may reduce the amount of cleaning composition that remains on the textile substrate after removal by vacuuming (lower number indicates less cleaning composition left behind on the carpet). More specifically, dipropylene glycol appears to be a preferred retrieval additive when compared with aluminum silicate clay. The results also show that adding more vacuum retrieval additive to the formulation does not necessarily achieve a higher rate of retrieval. Thus, this Example illustrates that by including a vacuum retrieval additive in the cleaning composition, the amount of cleaning composition removed from the substrate may be increased. In turn, the amount of cleaning composition that is left on the substrate is reduced. This is advantageous because the lowering the amount of residual cleaning compositions left on the substrate will reduce the textile substrate resoil rate.

II. Test Procedures and Discussion of Results

Spot Cleaning Test Procedure

This procedure was used to determine the effectiveness of various carpet cleaners to remove common household stains from carpet. This method also provided a way to compare different cleaners in their ability to remove stains.

Procedure

1. The carpet specimen was cut into pieces 10"×13." One 10"×13" piece was used to test up to ten stains per cleaner. Enough pieces were cut to test all cleaners on each stain to be evaluated plus one additional sample was cut for use as a control. For example, to test 12 cleaners on each of 10 stains, 13 of the 10"×13" pieces were needed.
2. The ten stains were placed on each carpet piece using a standard carpet staining technique. Each staining material was applied to each piece of carpet. The typical household stains that were tested were: lipstick, French salad dressing, ketchup, cola, shoe polish, grape juice, chocolate, motor oil, butter and coffee (cream & sugar). Stains are allowed to dry overnight after applying to the carpet.
3. One stain blanket to be cleaned by each cleaner was labeled. A Sharpie marker was used to label the backs of each stain blanket with the designated carpet cleaner. A code was used for each cleaner so that the evaluation will not be biased. One stain blanket was not cleaned and was used as a control to compare the effectiveness of each cleaner on stain removal.
4. Each stain was cleaned with the designated cleaner according to the package instructions (if commercial product) and allowed to dry overnight.
5. Five people, not involved in this project, were used to rank the residual stains after cleaning ranking from best to worse with 1 being the best. Rating: 1=completely removed, 2=very good (acceptable), 3=pretty good (borderline), 4=poor (unacceptable), 5=nothing removed (same as original).
6. The rankings were then averaged by cleaner and by stain. In some instances, only a visual notation was made to indicate whether the stains were removed in comparison to the control sample.

Cleaning Efficiency Test Procedure

This procedure was used to compare the cleaning ability (efficiency) of carpet cleaners using a standard soil in order to mimic carpet soiled by foot traffic.

Materials

Light colored carpet tiles (available from Milliken & Company of Spartanburg, S.C., Pattern #542903)

3M Soil

CSI Tumbler and Soil Bomb

Analytical balance

Top-loading balances

GLS scrubbing Machine, Whittaker

Windsor vacuum cleaner

GretagMacbeth Color-Eye7000A Colorimeter

Preparation

1. A clicking machine was used to cut 4½"×4½" pieces of light tan commercial grade 18"cut pile carpet tile. Each product or formulation tested was run in triplicate.
2. A template was prepared by clicking a 4½"×4½" piece from the center of a tile. ⅛" of carpet was trimmed from the inside edges of the hole in the template to allow for a good fit.
3. Another whole tile was taped to the bottom edge of the template.

Procedure

1. A 4½"×4½" piece of tile was placed into the hole in the template.
2. The GLS machine was used to make 2 passes (up and back) over the template and test carpet.
3. The Windsor vacuum was used to make 5 passes over the template and test carpet. Going up and back is considered one pass.

4. Steps 1-3 were repeated for each carpet piece.
5. The LAB values of each carpet piece was measured on the Color-Eye. This reading was recorded as "Lo."
6. 1.5 g of 3M soil was added to the soil bomb.
7. Four of the prepared test carpet pieces were placed on the Soiling Tumbler and the soil bomb was added.
8. Samples were tumbled for 30 minutes.
9. Carpet pieces were removed from the tumbler, and vacuum as in step #3.
10. The LAB values were measured on the Color-Eye; these values were called "Ls." Ls values must be within +/−3% (ex: Ls=42.0+/−1.3). Soiled pieces outside the proper range were not used.
11. Each tile was soiled, vacuumed and the LAB values were measured for all test carpet pieces as in steps 6-10.
12. The cleaning composition was then applied to the soiled carpet as described for each specific Example above.
13. The piece of carpet was then placed in the template.
14. The cleaning composition was scrubbed into the carpet using 3 passes with the GLS.
15. The carpet was removed from the template and was set aside to dry.
16. The empty template was vacuumed as in Step 3 above.
17. Steps 12-16 were repeated until all samples had been scrubbed.
18. When the cleaning composition had dried for 30 minutes (or the desired drying time), each piece was placed into the template and 5 passes were made with the Windsor vacuum.
19. The pieces were removed from the template and read on the Color-Eye; these values were called "Lc."
20. The cleaning efficiency was calculated for each piece using the formula below:

$$\text{Cleaning} = Lc\text{-}Ls \times 100$$

$$\text{Efficiency } Lo\text{-}Ls$$

21. Since three carpet pieces were used for each product or formulation, the average of the three cleaning efficiency values was reported.

Dusting Test Procedure

This procedure was used to compare the amount residual dust or powder left after cleaning carpet (often known as "frosting").

Materials

Dark colored carpet tiles (available from Milliken & Company, Pattern #542903)

Windsor vacuum cleaner

GretagMacbeth Color-Eye7000A Colorimeter

Preparation

1. A clicking machine was used to cut 4½"×4½" pieces of light tan commercial grade 18" cut pile carpet tile. Each product or formulation tested was run in triplicate.
2. A template was prepared by clicking a 4½"×4½" piece from the center of a tile. ⅛" of carpet was trimmed from the inside edges of the hole in the template to allow for a good fit.
3. Another whole tile was taped to the bottom edge of the template.

Procedure

1. A 4½"×4½" piece of tile was placed into the hole in the template.
2. The GLS machine was used to make 2 passes (up and back) over the template and test carpet.
3. The Windsor vacuum was used to make 5 passes over the template and test carpet. Going up and back is considered one pass.
4. Steps 1-3 were repeated for each carpet piece.
5. The LAB values of each carpet piece was measured on the Color-Eye. This reading was recorded as Lo.
6. The cleaning composition was then applied to the soiled carpet as described for each specific Example above.
7. The piece of carpet was placed in the template.
8. The cleaning formulation was scrubbed into the carpet using 3 passes with the GLS.
9. The carpet was removed from the template and was set aside to dry.
10. The empty template was vacuumed as in Step 3 above.
11. Steps 12-17 were repeated until all samples had been scrubbed.
12. When the formulation had dried for 30 minutes (or the desired drying time), each piece was placed into the template and 5 passes were made with the Windsor vacuum.
13. The pieces were removed from the template and read on the Color-Eye; these values were called Lc.
14. The relative amount of dusting was calculated for each piece using the formula below:

$$\text{Dusting Level} = Lc - Lo \text{ (higher number indicates greater amount of dusting)}$$

15. Since three carpet pieces were used for each product or formulation, the average of the three cleaning efficiency values was reported.

Examples 10A-10G

Example 10

Cleaning Solutions Using Various Dispersion Stabilizing Additives

I. Formulations

A base formulation was first prepared by mixing together the components of Example 10A. Various dispersion stabilizing additives were then added to this base formulation as shown below in Examples 10B-10E. Example 10F did not use this base formulation.

Example 10A i. A slurry base formulation was made according to the formulation in Example 5C above.

Example 10B

Thickened with 0.5% Hydroxyethylcellulose (HEC)

i. To 300 g of the slurry made by the above formulation in Example 10A, 1.5 g of HEC was gradually added and stirred for 30 minutes.
ii. PH of the final mixture was 8.5 and a stable dispersion was formed.

Example 10C 0.5% Kelzan S, a Xanthan Gum i. To 300 g of the slurry made by the above formulation in Example 10A, 1.5 grams of Kelzan S was added and stirred for an hour.
ii. A stable dispersion was formed.

Example 10D 0.5% Kelzan S i. 6 grams of Kelzan S was first dispersed in 294 grams of water and put under a lab homogenizer to mix for 2 minutes.
ii. 114.7 grams of this Kelzan S solution (i) was blended into 293 grams of the slurry made by the above formulation in Example 10A.
iii. The resultant mixture was a white, uniform stable dispersion.

Example 10E

1% Methacrylic Acid/Ethyl Acrylate Copolymer i. To 300 g of the slurry made by the above formulation in Example 10A, 3.0 grams of PD-75 (65/35 methacrylic acid/ethyl acrylate copolymer) was added. PH of the mix was 5-6.
ii. 50% sodium hydroxide was gradually added until pH was 9.8 and the mix turned somewhat viscous.
iii. The mix was stirred for 1 hour. A stable dispersion was formed.

Example 10F

2% Polyacrylamide i. To 300 grams hot tap water was added 6.0 grams of polyacrylamide (Trade Name Cyanatex 695).
ii. The granules dispersed and the mix was allowed to stir for 1 hour to form a very viscous fluid.
iii. After the viscosity had developed fully overnight 60 grams of UF polymer was added.
iv. Then 100 grams of Capture® Spot & Stain remover (available from Milliken and Company) was added and stirred for 30 minutes.
v. A very viscous, white stable dispersion was formed.

II. Test Procedures and Discussion of Results a. The formulation of Example 10C above was placed into a plastic squeeze bottle with plastic bristles. The formulation was squeezed onto a dirty spot on the carpet tiles and brushed in with the bristles. After the product dried, the dirty spot was no longer visible, nor was the dried dispersion.
b. The formulation of Example 10C was placed into a trigger spray bottle and was determined to be sprayable through the nozzle. No cleaning evaluation was done with the sprayed composition.
c. The formulation of Example 10D above was tested similarly on a larger dirty spot on broadloom carpet. Only part of the spot was treated. After the mixture dried, a white residue was visible where it was applied. After vacuuming the entire spot, the white residue was no longer visible. The treated area was lighter in color, like the clean areas of the rest of the carpet, whereas the untreated area was still dark with stain.
d. The formulation of Examples 10A above was tested on fabric to verify that the method of using the inventive cleaning composition does not adversely affect fabrics that will undergo standard laundering processes:
   i. Testing substrate was 100% cotton oxford flat weave.
   ii. Stain medium was burnt motor oil as defined in AATCC Method 130 (Soil Release: Oily Stain Release Method) and the fabric was stained with three rows of 4 stains each according to the staining procedure.
   iii. One row was treated with the formulation of Example 10A and brushed in and one was left untreated.
   iv. After the row with the formulation of Example 10A was dried, the entire substrate was washed and dried according to the Washing Procedure of AATCC Method 130, using Tide® Quick Dissolving Powder detergent, with a dummy load at 105 degrees F.
   v. The fabric was observed to be free from any defects (fraying, frizzing, disintegrating, etc.) after laundering, indicating that the inventive compositions and methods of cleaning with the compositions may be used on textile substrates such as fabrics, in addition to carpets.
e. The viscosity profile for the formulation of Example 10D was determined using a Brookfield RVT, spindle #6. The results are shown in Table 10 below.

TABLE 10

Viscosity of Example 10D

| RPM | Viscosity (cps) |
|---|---|
| 100 | 470 |
| 50 | 820 |
| 20 | 1750 |
| 10 | 3100 |
| 5 | 5400 |
| 2.5 | 9200 |
| 1 | 19000 |

Examples 11A-11C

The following Examples are provided to illustrate the differences in drying time and humidity in an area after the carpet in that area has been cleaned. These Examples compare the differences between: Example 11A—cleaning the carpet with Capture® dry powder cleaner, Example 11B—cleaning the carpet using hot water extraction, and Example 11C—cleaning the carpet using the inventive cleaning composition. The results are shown in Table 11 below. The humidity is measured as percent humidity and the temperature is measured in degrees F.

For each Example, an area of carpet measuring 18'×9.5' was cleaned. The humidity and temperature of the room and of the carpet was recorded before any cleaning was started. An EXTECH Humidity/Temperature Pen #445580 was placed on a surface 30" above the floor to obtain a reading for the room, and it was placed directly on the carpet to obtain a reading for the carpet. The door to the room remained closed throughout the cleaning session.

Example 11A

Cleaning Procedure for a Room using Capture® Dry Carpet Cleaner (a) one pound of Capture® was sifted onto the carpet and brushed in by attaching a Capture® brush to a handle (28.59 g/m$^2$ of Capture® was dispensed on the carpet); and (b) the humidity and temperature readings for the room and carpet were recorded every 15 minutes after cleaning was completed.

Example 11B

Cleaning Procedure for a Room using Hot Water Extraction (HWE)

(a) a Hoover Steam Vac V2 was used to clean the room;

(b) the directions for the steam vac were followed (one forward pass dispensed the chemical, one backward pass rinsed the carpet, and two full passes forward and backward retrieved any remaining liquid);

(c) three gallons of water and 15 ounces of steam cleaner chemical were needed to clean the room (713.85 g/m$^2$ of steam cleaner chemical was dispensed on the carpet); and (d) the humidity and temperature readings for the room and carpet were recorded every 15 minutes after cleaning was completed.

Example 11C

Cleaning Procedure for a Room using the Inventive Cleaning Composition (a) the inventive cleaning composition used above in Example 9A was applied to the carpet throughout the entire room using a trigger sprayer and was then was brushed into the surface of the carpet by attaching a Capture® brush to a handle;

(b) 227 g of the inventive cleaning composition was applied to the carpet (14.29 g/m$^2$ of inventive cleaning composition was dispensed on the carpet); and (c) the humidity and temperature readings for the room and carpet were recorded every 15 minutes after cleaning was completed.

TABLE 11

Comparison of % Humidity and Temperature Readings

| Elapsed Time (hour:min) | Ex. 11A Room Humidity (Temp.) | Ex. 11A Carpet Humidity (Temp.) | Ex. 11B Room Humidity (Temp.) | Ex. 11B Carpet Humidity (Temp.) | Ex. 11C Room Humidity (Temp.) | Ex. 11C Carpet Humidity (Temp.) |
|---|---|---|---|---|---|---|
| 0:00 | 17.1 (71.6) | 17.1 (71.6) | 17.6 (75.5) | 17.6 (75.5) | 24.9 (71.6) | 24.9 (71.6) |
| 0:15 | 23.2 (72.7) | 30.9 (72.7) | 56.4 (74.9) | 80.2 (74.8) | 29.9 (72.4) | 30.9 (72.9) |
| 0:30 | 22.2 (73) | 26.7 (73.3) | 65 (73.6) | 84 (72) | 28.2 (73.2) | 28.3 (73.9) |
| 0:45 | 21.8 (72.7) | 22.6 (73.3) | 55.5 (73.9) | 77.5 (73.3) | 28.6 (72.6) | 28.3 (73) |
| 1:00 | 19.9 (74.1) | 21 (74) | 52.4 (73.8) | 72.5 (73.4) | 26 (73.8) | 26 (74) |
| 1:15 | 20 (73) | 20.5 (73.1) | 50.2 (73) | 73.2 (72.9) | 26 (74.1) | 26 (74.1) |
| 1:30 | 20.3 (73.4) | 20.5 (73.6) | 47.3 (73.3) | 74.8 (72.4) | N/a | N/a |
| 1:45 | N/a | N/a | 45.1 (73.7) | 66.5 (73.1) | N/a | N/a |
| 2:00 | N/a | N/a | 45.1 (73.1) | 69.5 (72.6) | N/a | N/a |
| 2:15 | N/a | N/a | 41.5 (73.7) | 67.6 (73.4) | N/a | N/a |
| 2:30 | N/a | N/a | 41 (73.5) | 67.3 (72.8) | N/a | N/a |
| 2:45 | N/a | N/a | 39.1 (73.8) | 56.6 (73.3) | N/a | N/a |
| 3:00 | N/a | N/a | 39.5 (73.6) | 54.2 (73.1) | N/a | N/a |
| 3:15 | N/a | N/a | 36.9 (74) | 47.1 (73.8) | N/a | N/a |

"N/a" indicates no data was available.

The results in Table 11 illustrate the advantage of using the inventive cleaning composition, in a slurry or dispersion form, for cleaning carpet. The humidity and temperature recovery times are, by far, much shorter for the inventive cleaning composition of Example 11C than those for the hot water extraction cleaning procedure of Example 11B. This is advantageous because the cleaning cycle time is much shorter due to the ability of the inventive cleaning composition to adequately clean soiled carpet without overwetting the carpet surface, thereby providing a faster dry time. This allows for furniture and other items to be moved back onto the carpet more quickly. The results also illustrate that the inventive cleaning dispersion does not wet the carpet significantly more than the dry carpet cleaner of Example 11A, since humidity and temperature recovery times for both Example 11A and 11C are much more similar to each other than either are to Example 11B.

Thus, the inventive cleaning composition described herein provides clear textile substrate cleaning advantages over the prior art cleaning systems, such as hot water extraction cleaning systems and dry carpet cleaners. More specifically, and as illustrated by the Examples provided herein, the inventive cleaning composition provides many improvements over the prior art by improving, without limitation: (a) the convenience of applying a cleaning composition, (b) the cleaning efficiency of the cleaning composition, (c) the time a cleaned textile is wet, and (d) the reduction of the resoil rate caused by residual cleaning composition.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A method for cleaning a textile substrate, said method comprising the steps of:

(a) providing a soiled textile substrate;

(b) applying an effective amount of a liquid cleaning composition to at least a portion of said soiled textile substrate, wherein said liquid cleaning composition consists of:

(i) from 2.0 to 20 parts by weight of at least one absorbent particulate selected from the group consisting of a urea formaldehyde polymeric material polyurethane polystyrene, phenol-formaldehyde resin particles, water insoluble inorganic salt adjuvants, cellulosic particles, diatomaceous earth particles, wood particles, particles made from grains and other vegetable matter, cellulosic particles, inorganic particles and mixtures thereof, wherein said absorbent particulate has an average particle size of from about 10 to about 300 microns in diameter and an oil absorption value of at least 40;

(ii) at least 75 parts water, wherein said water contains a surfactant sufficient to provide a surface tension of less than about 40 dynes per centimeter;

(iii) from about 0.01 to about 50 parts by weight of a dispersion stabilizing agent selected from the group consisting of cellulosic polymers, starches, clay compounds, xanthan gums, polyacrylic acids and esters, polyacrylamide, polyvinyl alcohol and mixtures thereof, wherein said dispersion stabilizing agent is present in an amount sufficient to produce a stable or easily redispersed dispersion; and (iv) from about 0.01 to about 50 parts by weight of at least one compound selected from the group consisting of an organic liquid, an acrylic stain resist agent, a pH adjuster, a biocide, an aerosol propellant, a static reducing additive, a dust suppressing additive, a vacuum retrieval additive, a metal ion chelator, and a fragrance;

(c) agitating said liquid cleaning composition to produce a composite material comprised of said liquid cleaning composition and soil particles removed from said soiled textile substrate;

(d) allowing said composite material to dry; and (e) removing said composite material from said textile substrate.

2. The method of claim 1, wherein said step (b) of applying an effective amount of a liquid cleaning composition comprises spraying said liquid cleaning composition onto said soiled textile substrate using a trigger, pump, or electrical sprayer, wherein said electrical sprayer is battery or power operated.

3. The method of claim 1, wherein said step (b) of applying an effective amount of a liquid cleaning composition comprises dispensing said liquid cleaning composition onto said soiled textile substrate from a packaging container, wherein the interior volume of said packaging container is less than about one gallon.

4. The method of claim 3, wherein said packaging container includes a removable cap for dispensing the liquid cleaning composition.

5. The method of claim 3, wherein said packaging container has a synthetic applicator tip at one end of said packaging container.

6. The method of claim 5, wherein said synthetic applicator tip includes an opening for dispensing said cleaning composition.

7. The method of claim 5, wherein said synthetic applicator tip is comprised of synthetic bristles or foam.

8. The method of claim 1, wherein said step (b) of applying an effective amount of a liquid cleaning composition comprises dispensing said liquid composition onto said soiled textile substrate using a carpet cleaning machine.

9. The method of claim 8, wherein said soiled textile substrate is a carpet.

10. The method of claim 8, wherein said soiled textile substrate is an upholstery fabric.

11. A system for cleaning a textile substrate, said system comprising:

(a) a packaging container, wherein said packaging container includes (i) a removable cap at one end of said packaging container;

(ii) an applicator tip attached to said removable cap;

(iii) a scrubbing mechanism attached to said applicator tip; and (iv) an interior volume of less than about one gallon; and (b) a liquid cleaning composition within said packaging container, wherein said cleaning composition consists of:

(i) from 2.0 to 20 parts by weight of at least one absorbent particulate selected from the group consisting of a urea formaldehyde polymeric material, polyurethane, polystyrene, phenol-formaldehyde resin particles, water insoluble inorganic salt adjuvants, cellulosic particles, diatomaceous earth particles, wood particles, particles made from grains and other vegetable matter, cellulosic particles, inorganic particles and mixtures thereof, wherein said absorbent particulate has an average particle size of from about 10 to about 300 microns in diameter and an oil absorption value of at least 40;

(ii) at least 75 parts water, wherein said water contains a surfactant sufficient to provide a surface tension of less than about 40 dynes per centimeter;

(iii) from about 0.01 to about 50 parts by weight of a dispersion stabilizing agent selected from the group consisting of cellulosic polymers, starches, clay compounds, xanthan gums, polyacrylic acids and esters, polyacrylamide, polyvinyl alcohol and mixtures thereof, wherein said dispersion stabilizing agent is present in an amount sufficient to produce a stable or easily redispersed dispersion; and (iv) from about 0.01 to about 50 parts by weight of at least one compound selected from the group consisting of an organic liquid, an acrylic stain resist agent, a pH adjuster, a biocide, an aerosol propellant, a static reducing additive, a dust suppressing additive, a vacuum retrieval additive, a metal ion chelator, and a fragrance;

wherein said liquid cleaning composition is easily dispensed onto a textile substrate from within said packaging container through said opening of said packaging container.

12. The system of claim 11, wherein said scrubbing mechanism is a plurality of synthetic bristles extending outward from said applicator tip.

13. The system of claim 11, wherein said scrubbing mechanism is a foam material.

14. The system of claim 11, wherein said textile substrate is a carpet.

15. The system of claim 11, wherein said textile substrate is a fabric.

16. The system of claim 15, wherein said fabric is an upholstery fabric.

* * * * *